US008066555B2

(12) United States Patent
Bajaj

(10) Patent No.: US 8,066,555 B2
(45) Date of Patent: Nov. 29, 2011

(54) POLISHING PAD

(75) Inventor: Rajeev Bajaj, Fremont, CA (US)

(73) Assignee: SemiQuest inc., San Jose, CA (US)

( * ) Notice: Subject to any disclaimer, the term of this patent is extended or adjusted under 35 U.S.C. 154(b) by 86 days.

(21) Appl. No.: 12/676,318

(22) PCT Filed: Aug. 28, 2008

(86) PCT No.: PCT/US2008/074658

§ 371 (c)(1),
(2), (4) Date: Apr. 27, 2010

(87) PCT Pub. No.: WO2009/032768

PCT Pub. Date: Mar. 12, 2009

(65) Prior Publication Data

US 2010/0203815 A1 Aug. 12, 2010

Related U.S. Application Data

(60) Provisional application No. 60/969,684, filed on Sep. 3, 2007.

(51) Int. Cl.
*B24D 11/00* (2006.01)

(52) U.S. Cl. ..... 451/527; 451/529; 451/533

(58) Field of Classification Search ..... 451/527, 451/529, 533
See application file for complete search history.

(56) References Cited

U.S. PATENT DOCUMENTS

| | | | | |
|---|---|---|---|---|
| 6,964,604 | B2 * | 11/2005 | Chen et al. | 451/532 |
| 6,988,942 | B2 * | 1/2006 | Chen et al. | 451/533 |
| 7,029,747 | B2 * | 4/2006 | Huh et al. | 428/217 |
| 7,815,778 | B2 * | 10/2010 | Bajaj | 204/224 M |
| 2007/0131564 | A1 | 6/2007 | Bajaj | |

OTHER PUBLICATIONS

SEMIQUEST, Inc.; PCT/US2008/074658 filed Aug. 28, 2008; International Preliminary Report on Patentability; IPEA/US; mailed Aug. 3, 2010; 9 pp.

PCT/US2008/074658 filed Aug. 28, 2008, Semiquest, Inc. et al, International Search Report and Written Opinion, ISA/US, 8pp.

* cited by examiner

*Primary Examiner* — Maurina Rachuba
(74) *Attorney, Agent, or Firm* — SNR Denton US LLP

(57) ABSTRACT

A polishing pad includes polishing elements interdigitated with one another over a surface of the polishing pad. Each of the polishing elements is secured so as to restrict lateral movement thereof with respect to others of the polishing elements, but remains moveable in an axis normal to a polishing surface of the polishing elements. Different densities of the polishing elements may be positioned within different areas of the surface of the polishing pad.

10 Claims, 6 Drawing Sheets

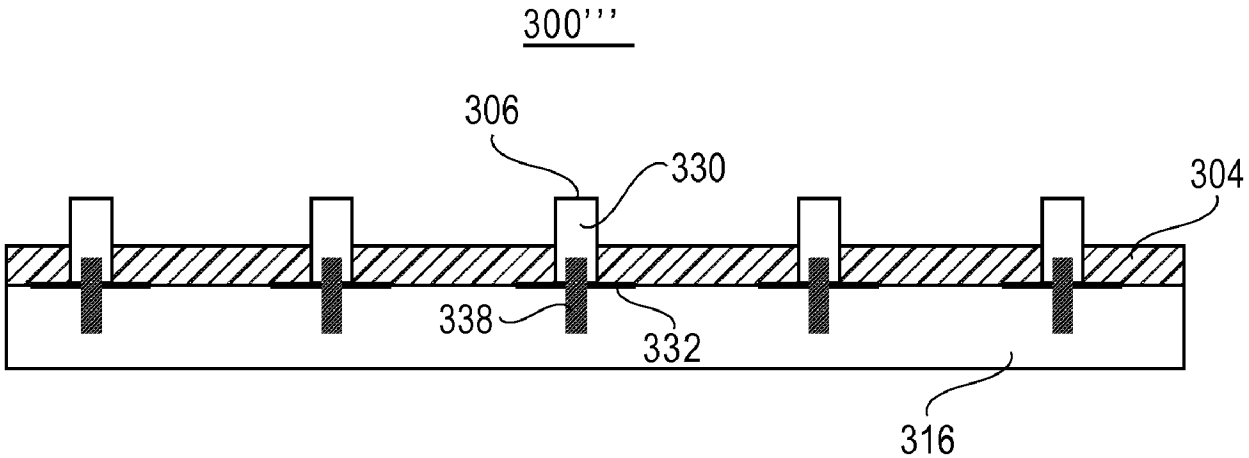
FIG. 4
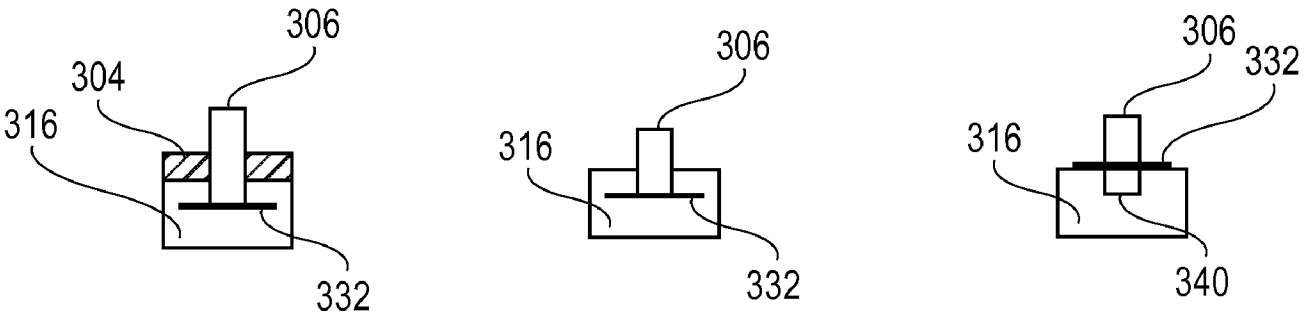
FIG. 5A
FIG. 5B
FIG. 5C

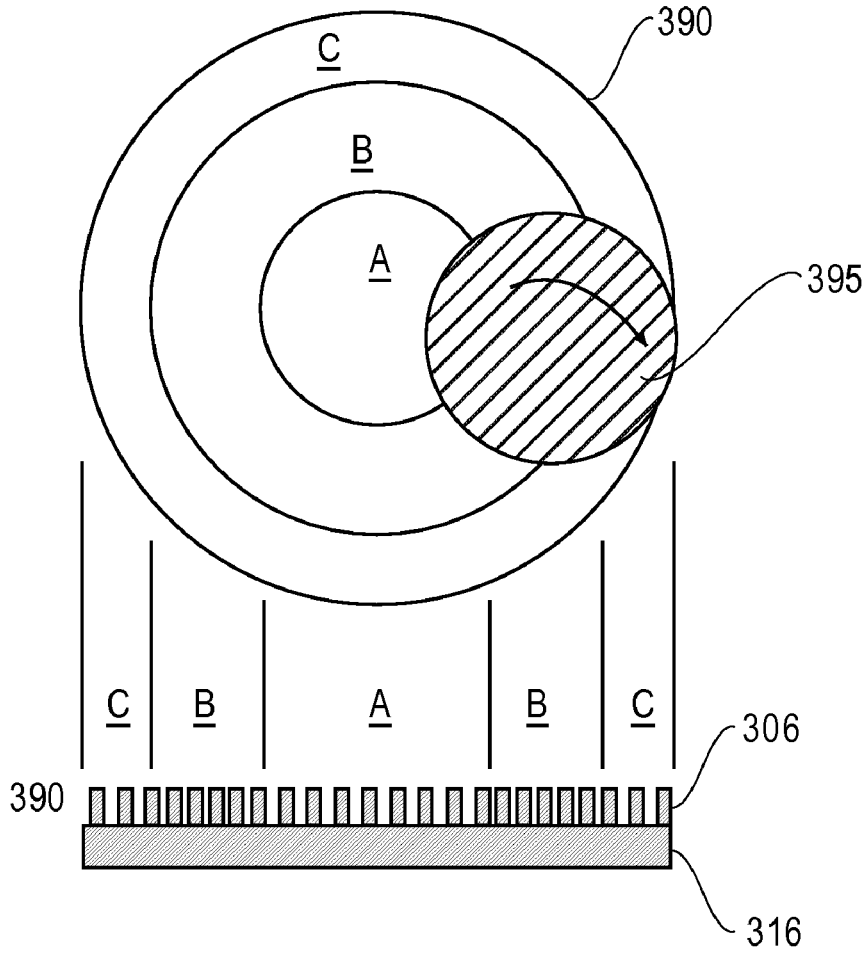
FIG. 11
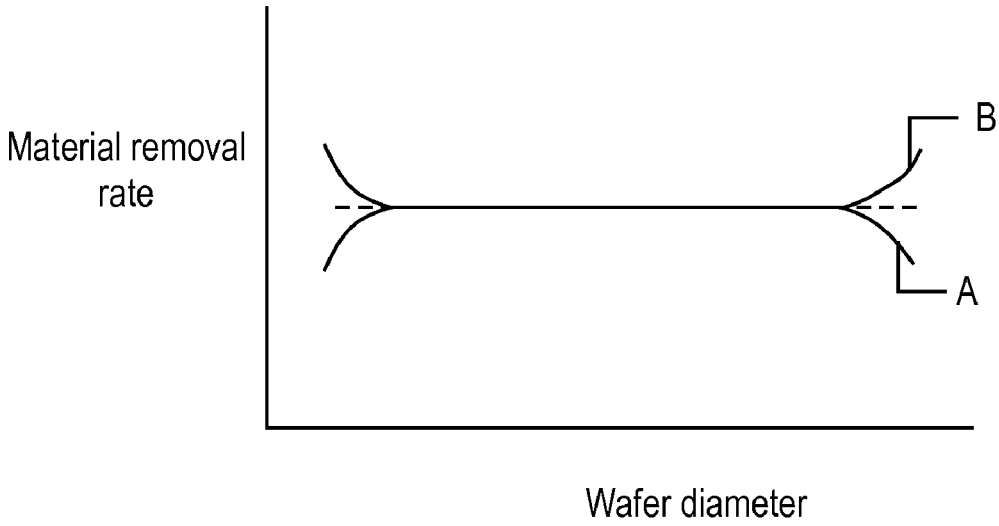

POLISHING PAD

RELATED APPLICATIONS

This application is a National Stage under 35 USC 365 and claims priority to PCT International Application No. PCT/US2008/0074658 filed Aug. 28, 2008, incorporated herein by reference, which claims priority benefit from U.S. Provisional Patent Application 60/969,684 filed Sep. 3, 2007.

FIELD OF THE INVENTION

The present invention relates to the field of polishing pads such as are utilized in chemical mechanical planarization (CMP) and other applications.

BACKGROUND

In U.S. patent application Ser. No. 11/697,622, filed 6 Apr. 2007 (hereinafter the "'622 Application"), which application is assigned to the assignee of the present invention and incorporated herein by reference, an improved polishing pad for CM P and other applications was described. The polishing pad described in the '622 Application, embodiments of which are illustrated as pad 300 in FIGS. 1A-1B, includes a guide plate 308 having affixed thereto a compressible under-layer 316. An optional porous slurry distribution layer 304 may be affixed to the other side of the guide plate. A plurality of polishing elements 306 protrude through the guide plate 308 so as to be maintained in planar orientation with respect to one another and the guide plate.

The polishing elements 306 are affixed to the compressible under-layer 316 (or to a housing), with each polishing element protruding In use, the polishing pad 300 is placed on top of the polish table 318, which rotates relative to the wafer being polished, and the polishing elements of the polishing pad make contact (typically under pressure) with a wafer 320 at a contact surface. If used, slurry distribution material 304 provides flow control in the slurry pathways between polishing elements 306.

The foundation of the polishing pad described in the '622 Application is the guide plate 308, which provides lateral support for the polishing elements 306. The guide plate includes holes to accommodate each of the polishing elements 306, thus leaving the polishing elements free to move in a vertical direction with respect to their long axis.

SUMMARY OF THE INVENTION

In one embodiment, the present invention provides a polishing pad that includes a plurality of polishing elements interdigitated with one another over a compressible surface. Each of the polishing elements is secured so as to restrict lateral movement thereof with respect to others of the polishing elements, but remains moveable in an axis normal to a polishing surface of the polishing elements. The polishing pad may also include a compressible under layer, with each of the polishing elements being secured to the compressible under layer and protruding above a top surface thereof. The polishing elements may be secured to the compressible under layer using clamps, for example, "L"-shaped clamps, "T"-shaped clamps, torus-shaped clamps, or other styles of clamps. In some cases, the compressible under layer is not continuous and each (or some of) polishing pad is affixed to an individual compressible under layer, spring, or similar material so as to provide translation in a vertical direction. In some cases, some of the polishing elements may interlock with others of the polishing elements. Alternatively, or in addition, the polishing elements may be secured using wires embedded within the compressible under layer of the polishing pad. The polishing elements may have a Shore D hardness greater than 80.

BRIEF DESCRIPTION OF THE DRAWINGS

The present invention is illustrated by way of example, and not limitation, in the figures of the accompanying drawings, in which:

FIG. 4 is a cut-away side view of a polishing pad configured according to one embodiment of the present invention in which pins are used to secure polishing elements to a compressible under layer.

FIGS. 5A-5C illustrate various configurations for securing polishing elements to compressible under layers of polishing pads in accordance with various embodiments of the present invention.

FIG. 11 illustrates an example of a polishing pad configured with different densities of polishing elements across the diameter of the pad.

DETAILED DESCRIPTION

Figure 1A:
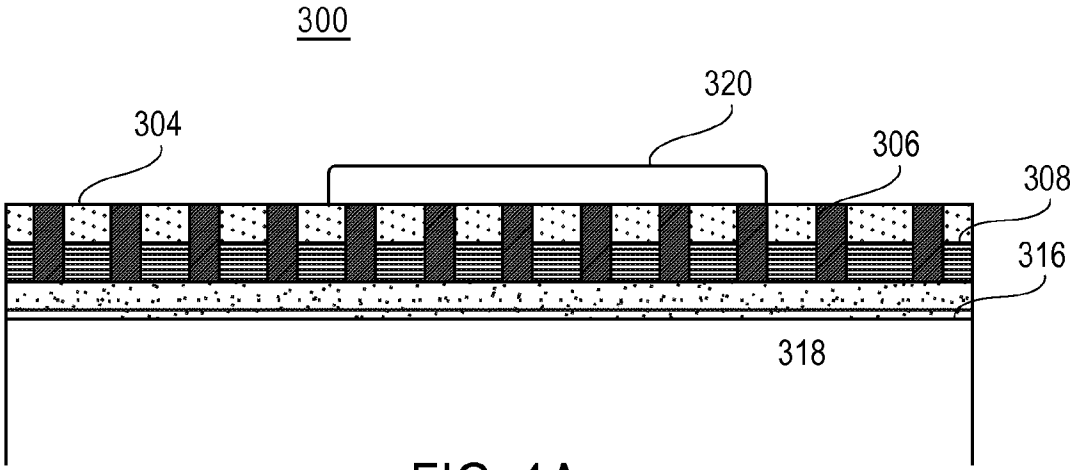
FIGS. 1A-1B are cut-away side views of CMP polishing pads having individual polishing elements capable of vertical translation with respect to the base of the pad.
Figure 1B:
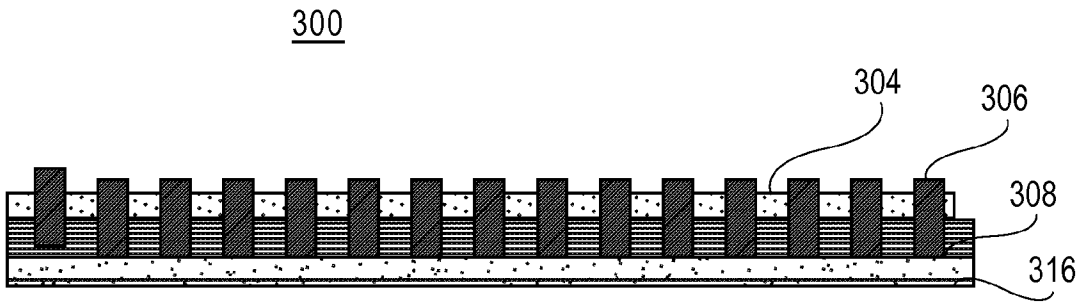

Described herein are various embodiments of polishing pads (e.g., pad that may be used for CMP applications) and processes for using such pads (e.g., for polishing semiconductor wafers and structures layered thereon, including metal damascene structures on such wafers). The present invention recognizes the impact of the physical characteristics of a polishing pad in the quality of CMP processing. Specifically, it is known that a more flexible polishing pad produces dishing while a harder pad with reduced slurry distribution produces more surface defects. Although various polishing pad configurations (e.g., with specific examples of geometric ranges, ratios, and materials) and polishing processes are exemplified herein, it should be appreciated that the present invention can be equally applied to encompass other types of polishing pad fabrication materials and deposition removal techniques. Stated differently, the use of such other materials and techniques are deemed to be within the scope of the present invention.

In use, pads configured in accordance with embodiments of the present invention may be placed on a polish table while a wafer is pressed against the polishing pad with a suitable down force. Slurry is applied to the pad surface while it is rotated relative to the wafer. Some embodiments of the present polishing pads include a slurry distribution layer to aid in the distribution of slurry across the polishing pad and the wafer surface.

In polishing pads configured in accordance with the present invention, polishing elements are mounted so that they are interdigitated with one another; and restricted from lateral movement with respect to others of the polishing elements, but moveable in an axis normal to a polishing surface of the polishing elements. That is, vertical motion of the polishing elements is permitted (e.g., compression or extension along an axis normal to the polishing surface of the polishing element), but lateral motion is prevented (e.g., by the use of pins, clamps, or other restraining mechanisms, or by embedding the polishing elements within under layers of the polishing pad). In some cases, each polishing element is free to move in the vertical direction independent of any neighboring polishing elements. In other cases, groups of neighboring polishing elements act in concert but distinctly from neighboring groups of polishing elements. During polishing operations the polishing elements each apply local pressure to the wafer to achieve good planarity.

In varying embodiments of the present invention, the polishing elements of the pad may be made of any suitable material such as polymer, metal, ceramic or combinations thereof. In some cases, the polishing elements may be made of an electrically conductive material such as a conductive polymer polyaniline commercially known as Pani™ (available under trade name ORMECOM™), carbon, graphite or metal filled polymer. In other embodiments, the polishing elements may be made of a thermally conductive material, such as carbon, graphite or metal filled polymer. One suitable material for the polishing elements of the present polishing pad is cast or molded polyurethane, such as DOW Pellethane™ 2201 65D. Other polymer materials such as Torlon™ or Delrin™ may also be used. The polishing elements may be polymeric or may contain abrasive materials such as silica or alumina. In some cases, the polishing elements may be made of PVA to provide good cleaning ability to the pad. The polishing elements may be of different sizes and, as discussed further below, may be positioned with varying density across the pad surface. In some embodiments, the polishing elements have a Shore D hardness greater than 80.

Where used, the slurry distribution material may be an open cell foam and the compressible under-layer a closed cell foam. The material for the under-layer is preferably selected to provide compliance of the order of wafer level bow and warpage. A suitable under-layer material may be performance polyurethane made by Rogers Corporation. Also in varying embodiments of the invention, a pad made from elements that preferentially polish copper and that is used to remove copper utilizing copper slurry may be used. Likewise, a barrier pad may be made from elements that preferentially polish barrier materials, such as Ta/TaN or other such refractory metals, and used to remove barrier materials utilizing barrier slurry. In a further embodiment of the invention, a composite pad containing both copper and barrier removal elements is utilized to remove both copper and barrier materials on single polish platen.

When pads configured in accordance with the present invention are in use (i.e., when the pad is moving relative to a wafer surface), the polishing elements may make sliding contact or rolling contact with the wafer's surface. In this latter case, one or more polishing elements may have a cylindrical body and a rolling tip. The rolling tip may be made of varying materials, such as polymeric, metal oxide or an electrically conducting material. A rolling tip polishing element may be incorporated into the pad material the same way as a sliding contact polishing element.

Figure 2B:
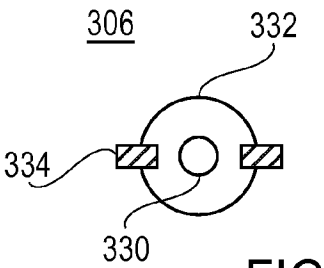
FIG. 2B is a top view of a single polishing element and associated clamps of the pad shown in FIG. 2A.
Figure 2A:
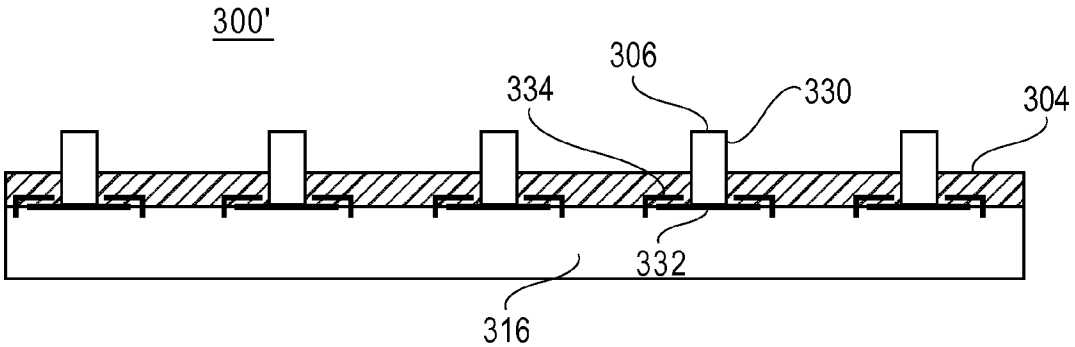
FIG. 2A is a cut-away side view of a polishing pad configured according to one embodiment of the present invention in which L-shaped clamps are used to secure polishing elements to a compressible under layer.

As indicated above, the polishing pad described in the '622 Application made use of a guide plate to limit movement of the polishing elements to only the vertical plane (i.e., towards or away from the wafer being polished). In contrast, some embodiments of the present polishing pad do not include a guide plate. For example, and as shown in FIGS. 2A and 2B, a polishing pad 300' configured in accordance with one embodiment of the present invention includes clamps 334 to restrict lateral movement of the polishing elements 306 while still permitting vertical movement thereof.

In this example, pad 300' includes a compressible under layer 316 and an optional slurry distribution layer 304, but no guide plate. Instead, the polishing elements 306 are affixed to the compressible under layer 316 (e.g., by adhesive) at a base 332. In other cases, the polishing elements may simply be positioned on the compressible under layer 316 and the slurry distribution layer 304 affixed (e.g., by adhesive) to the compressible under layer 316 so as to sandwich a base 332 of the polishing elements 306 therebetween. A tip 330 of the polishing element 306 protrudes (e.g., through holes in the slurry distribution layer) above the slurry distribution layer 304 and in use would make contact with the wafer or other material being polished.

In some cases, the above arrangement will be sufficient to prevent lateral movement of the polishing elements 306. That is, the slurry distribution layer 304 may be sufficiently stiff and sufficiently securely fastened to the compressible under layer so as to prevent such lateral movement. In these cases, no guide plate or any other form of lateral motion restriction is required.

In other cases, in order to prevent lateral movement of the polishing elements 306 with respect to the compressible under layer 316, one or more clamps 334 are used around the periphery of the base 332 of each polishing element. Each clamp 334 has an "L"-type shape, with a first (horizontal) portion extended over at least part of the base 332 of a polishing element 306, and a second (vertical) portion inserted into (and possibly cemented within) the compressible under layer 316. In practice, two or four (or more) clamps 334 distributed circumferentially around the base 306 of each polishing element 306 should suffice to limit the lateral movement of the polishing elements during polishing operations.

In some cases, a "T"-shaped clamp may be used to secure the bases of two neighboring polishing elements. Such a configuration may, however, cause the vertical movement of one polishing element to affect the movement of its neighbor.

Hence, the L-shaped clamps may be preferred where independent polishing element movement is important.

Figure 3B:
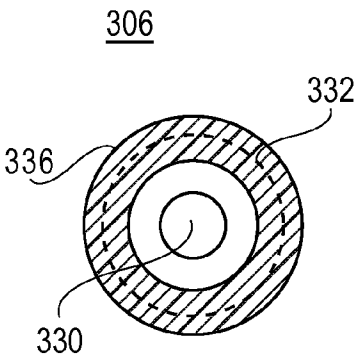
FIG. 3B is a top view of a single polishing clement and associated ring-shaped clamp of the pad shown in FIG. 3A.
Figure 3A:
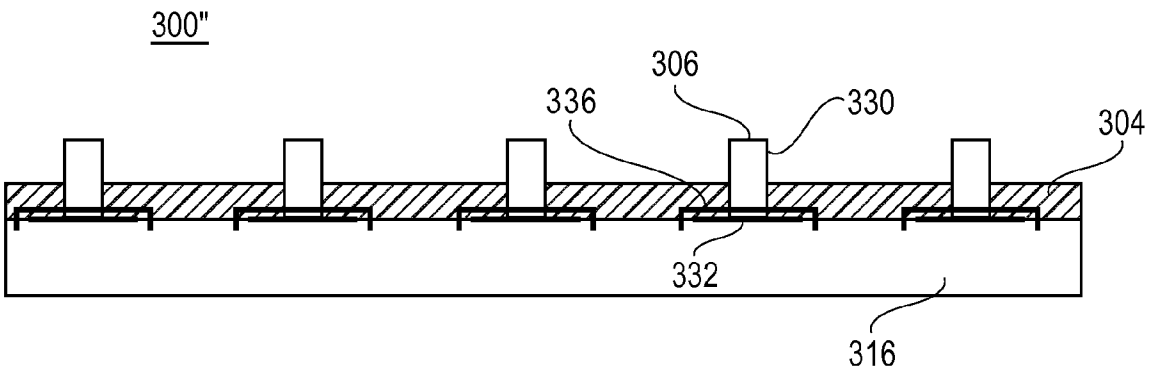
FIG. 3A is a cut-away side view of a polishing pad configured according to one embodiment of the present invention in which ring-shaped clamps are used to secure polishing elements to a compressible under layer.

An alternative to the L-shaped or T-shaped clamps is illustrated in FIGS. 3A and 3B. In this example of a polishing pad 300", a ring-shaped or torus-shaped clamp which encircles the base 332 of a polishing element 306 is used. The ring or torus has a portion that extends over at least part of the base 332 of a polishing element 306, and flange or prong that inserts into (and is possibly cemented within) the compressible under layer 316.

Yet another alternative is illustrated in FIG. 4. In this example of a polishing pad 300'", a pin 338 is used to secure a polishing element to the compressible under layer 316. The pin 338 extends at least partially into the polishing element 306 and also into the compressible under layer 316. As a further means of securing the polishing element, the pin may be cemented into either or both of the polishing element and/or the compressible under layer of the pad. Care must be taken with such pins to make sure that they do not extend to the working tip of the polishing element so that wear of that tip would expose the pin and possibly lead to pin-wafer contacts that would result in scratches or other damage to the wafer.

In any or all of the above-described embodiments of polishing pads, the polishing elements 306 may be mounted or positioned on top of the compressible under layer 316. Alternatively, as shown in FIGS. 5A-5C, the polishing elements may be embedded (at least partially) within the compressible under layer 316. For example, FIG. 5A illustrates a polishing element 306 embedded within the compressible under layer 316 and protruding through a hole in the slurry distribution layer 304. The polishing element may be secured using adhesive and may or may not include a base 332. In sonic cases a base 332 is preferable inasmuch as it provides additional resistance against lateral movement when embedded within compressible under layer 316 and also will help prevent the polishing element from becoming loose from the compressible under layer.

FIG. 5B illustrates a similar arrangement to that shown in FIG. 5A, however, in this case no slurry distribution layer is used. Instead, the pad consists only of the compressible under layer 316 with embedded polishing elements 306 protruding therefrom (e.g., through holes in the compressible under layer). Pads such as that shown in FIGS. 5A and 5B may be manufactured with a single layer compressible under layer, with the polishing elements inserted base first through the holes, or with two-layer (or multi-layer) compressible under layers, with the polishing elements being sandwiched between such layers.

FIG. 5C illustrates yet another alternative for securing a polishing element 308 to a compressible under layer 316 of a polishing pad. In this instance, the polishing element 306 includes a tip 330, a base 332 and an anchor 340. The anchor 340 is inserted and affixed (e.g., by adhesive) within a hole in the compressible under layer 316. The base 332 may also be affixed (e.g., by adhesive) to the compressible under layer 316. Although this embodiment is shown without a slurry distribution layer, such a layer may be included if so desired or required by the application for which the pad is intended.

Figure 6C:
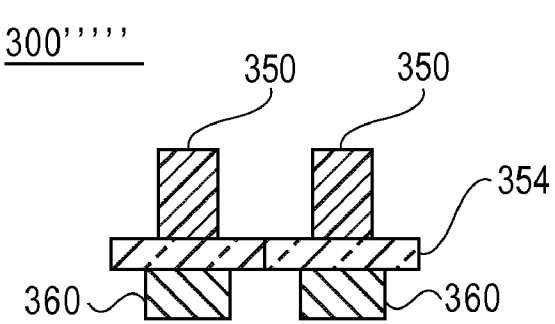
FIG. 6C illustrates one embodiment of a polishing pad having a non-continuous compressible under layer and in which interlocking polishing elements as shown in FIGS. 6A and 6B are used.
Figure 6B:
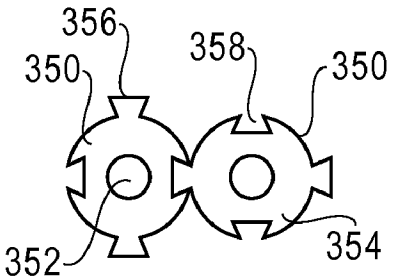
FIGS. 6A and 6B illustrate examples of interlocking polishing elements for use in accordance with polishing pads configured according to embodiments of the present invention.
Figure 6A:
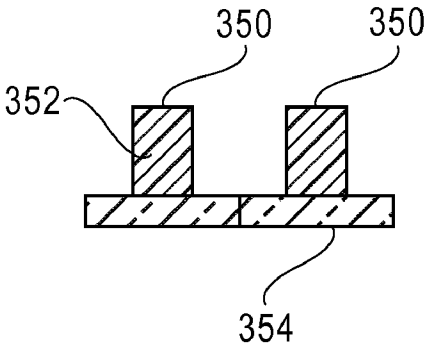

Turning now to FIGS. 6A and 6B, a different arrangement of polishing elements is illustrated. Polishing elements 350 include tips 352 and bases 354. Bases 354 include tongue portions 356 and groove portions 358. As shown in the illustrations, the tongue portions 356 of one polishing element 350 are adapted to interlock with the groove portions 358 of a neighboring polishing element 350, thereby preventing (or at least restricting) the neighboring polishing elements from moving laterally with respect to one another when arranged as part of a polishing pad.

The interlocking polishing elements 350 may be used in conjunction with any of the above-described polishing pads or, as shown in FIG. 6C, may be used as part of a polishing pad 300"" which includes non-continuous compressible under layer 360. That is, each polishing element 350 may be affixed (e.g., by adhesive, epoxy, etc.) to an individual compressible under layer 360, but the individual under layers are separate from one another. The compressible under layer 360 may be a spring-like substance, foam, polymer, or other compliant material that allows for vertical translation of the respective polishing element 350. Thus, the polishing elements remain free to move in the vertical direction, but are restricted from movement (as a result of the interlocking nature of the bases 354) laterally. Such an arrangement may need to be contained in a rigid housing, such as that shown in FIG. 1A. In some cases, at least some of the polishing elements may be connected with others of the polishing elements with a flexible connection.

Figure 7:
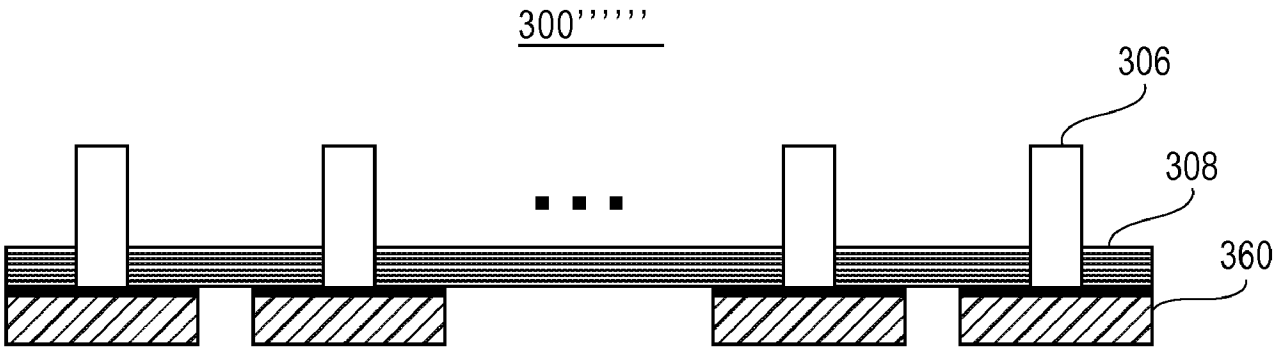
FIG. 7 illustrates a polishing pad configured in accordance with an embodiment of the present invention and including a polishing elements with individual compressible under layers and a common guide plate.

The use of a non-continuous compressible under layer is not restricted to the use of interlocking polishing elements. For example, as shown in FIG. 7, a pad 300""" may include polishing elements 306 with individual compressible under layers 360 and a guide plate 308, which acts to secure the polishing elements against lateral movement with respect to one another. The polishing elements 306 protrude through holes in the guide plate, and the individual compressible under layers 360 may be affixed to the guide plate (e.g., by adhesive or epoxy) to further preclude lateral movement of the polishing elements. As with all of the other embodiments described herein, the use of a slurry distribution layer and/or a membrane is optional with pad 300""". Pad 300""" may include a rigid housing (not shown), as discussed above.

Figure 8:
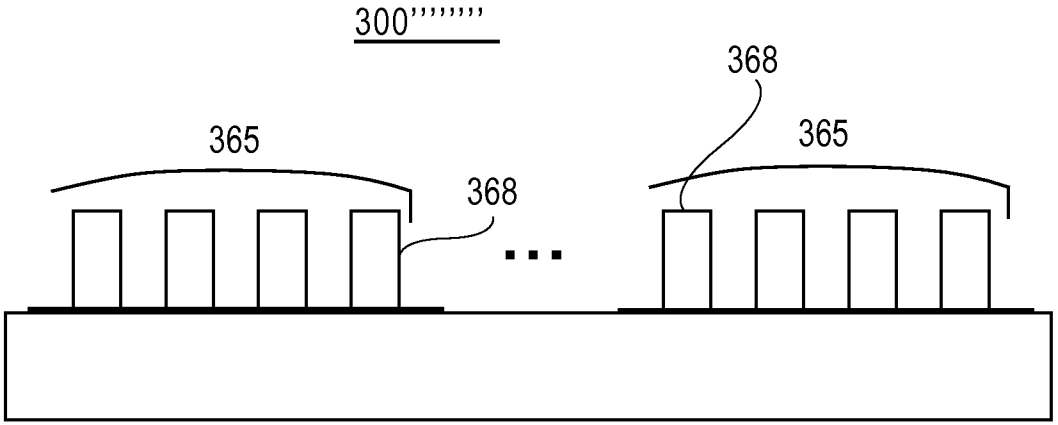
FIG. 8 illustrates a polishing pad configured in accordance with yet a further embodiment of the present invention and including groups of polishing elements which act in concert but independently from other groups.

Turning now to FIG. 8, a polishing pad 300""" configured in accordance with yet a further embodiment of the present invention is illustrated. This polishing pad includes a compressible under layer 316 and groups 365 of polishing elements 368 which act in concert but independently from other groups. That is, the polishing elements 368 of a group 365 may have a common base 370 or be of the interlocking variety, so that these polishing elements tend to move collectively when considering movement in the vertical direction. However, the groups of polishing elements are distinct from one another (i.e., not formed on a Common base or not interlocked), so that the different groups move independently of one another in the vertical direction.

Although illustrated as being included on a common compressible under layer 316, this pad 300""" may make use of separate compressible under layer portions for each group 365 of polishing elements. IN such a case, common guide plate for the pad may be used to prevent lateral movement of the polishing element groups with respect to one another. Also, although not shown the pad may be configured with a slurry distribution layer and/or a membrane and may also be accommodated with a rigid housing. Also, any of the above-described means for securing the polishing elements to the compressible under layer(s) may be used.

Figure 9:
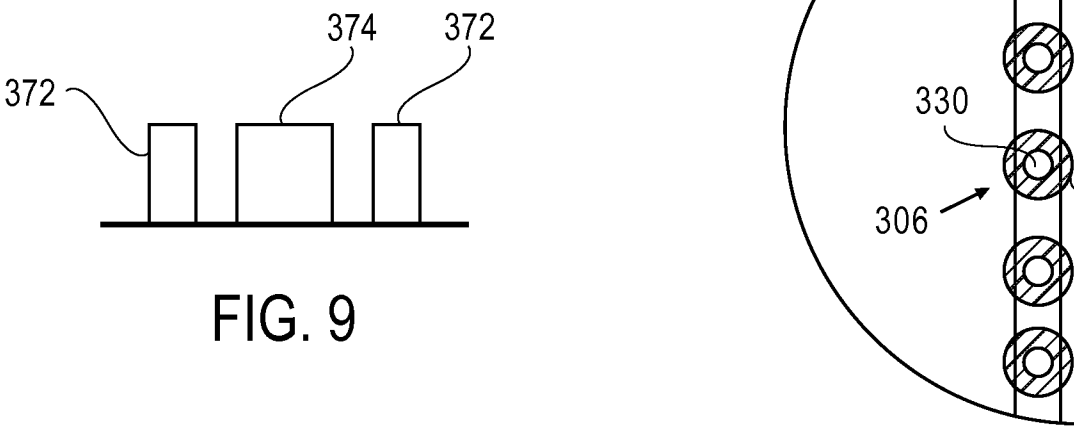
FIG. 9 illustrates the use of polishing elements of different dimensions within a single polishing pad in accordance with yet a further embodiment of the present invention.

FIG. 9 illustrates the use of polishing elements 372, 374 of different dimensions within a single polishing pad in accordance with yet a further embodiment of the present invention. These polishing elements may be individual or collectively may be found in a group of polishing elements. Or, in some cases, different groups may include polishing elements of different sizes. That is, within a group, all polishing elements may be of uniform size (i.e., width), which size may be different from other polishing elements of other groups within the same polishing pad. Likewise, polishing elements of different shapes may be found within a single group or within different groups of polishing elements. Various shapes and sizes for polishing elements were discussed in the '622 Application.

Figure 10:
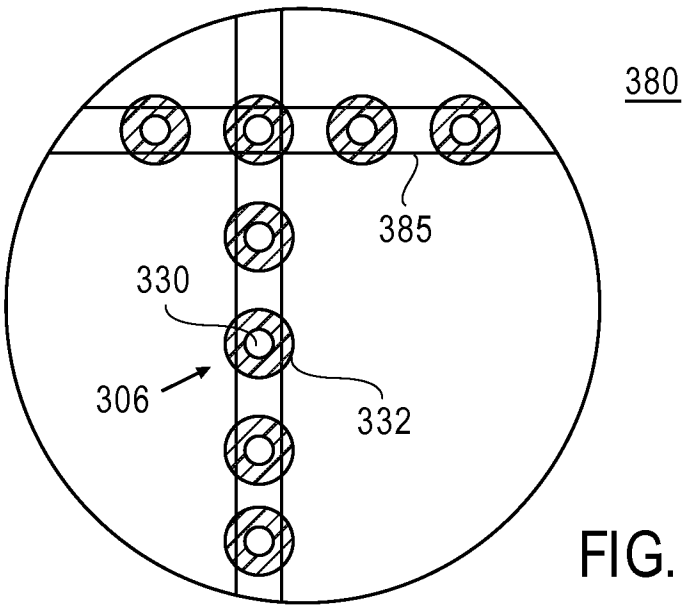
FIG. 10 illustrates the use of a grid or mesh of restraining wires to secure polishing elements against lateral movement with respect to One another in accordance with yet a further embodiment of the present invention.

FIG. 10 is a cut-away top view of a polishing pad 380. This polishing pad includes polishing elements 306, having tips 330 and bases 332. Other forms of polishing elements, such as those with interlocking bases, may be used. In this pad 380, restraining wires 385 arc positioned so as to secure the polishing elements 306 against lateral movement with respect to one another. In this simplified diagram, one set of horizontal and one set of vertical restraining wires 385 are shown, but in practice an entire grid or mesh of such wires may be used to secure the polishing elements 306. Disposed over the restraining wires may be a further compressible under layer or a slurry distribution layer (not shown).

The restraining wires may be made of any suitable material and need not be metal. Indeed, metal may not be preferred inasmuch as the use of metal wires may pose a hazard for a foam-based compressible under layer. That is, the metal may protrude as a result of wear of the foam, risking damage to the wafer or other material being polished. Hence, any rigid material, such as plastic, or even a hard foam material, etc., may be used For the restraining wires 385.

In the '622 Application, it was noted that polishing pads may be configured with different densities of polishing elements across the diameter of the pad. FIG. 11 illustrates an example of such a configuration. Polishing pad 390 is divided into three zones, A B and C. Note, the use of three zones is merely for purposes of this example. In practice, any number of zones, whether radially defined (as shown) or otherwise, may be used. Zone A represents a center portion of the pad, zone B a torus-shaped portion surrounding zone A, and zone C an outer torus-shaped portion surrounding zone B and extending to the periphery of the pad 390.

A wafer 395 is shown on top of the pad 390 to illustrate that when the pad 390 is used for polishing, and the wafer and pad are rotated with respect to one another, the different zones of the pad contact the wafer for different periods of time and at different portions of the pad. Most of the polishing of the wafer occurs while the wafer is in contact with zone B of the polishing pad. Only the periphery of the wafer is contacted by zones A and C.

As illustrated in the side view of polishing pad 390 in the figure, the different zones of the polishing pad include different densities of polishing elements 306. of course, any of the above-described types and configurations of polishing elements may be used and the discussion regarding polishing elements 306 disposed on a compressible under layer 316 is merely for purposes of illustration. As shown, the density of polishing elements 306 within zone B is greater than that of zones A or C. In one embodiment, zone B may have a 55% density of polishing elements, while zones A and C each have a 28% density of polishing elements. By density of polishing elements is meant the relative measure of polishing elements to no polishing elements over the surface of the polishing pad within the respective zone. Alternatively, zone B may have a lesser density of polishing elements that either of zones A or C. For example, zone B may have a 28% density of polishing elements, while zones A and C may each have a 55% density of polishing elements The graph at the bottom of the illustration shows how the relative density of the polishing elements affects the material removal rate on the wafer. Curve A represents a removal rate profile for the instance where zone B has a greater density of polishing elements than zones A and C. Curve b represents a removal rate profile where zone B has a lesser density of polishing elements than zones A and C.

The polishing pads described herein may be used in a variety of steps associated with CMP processing. This includes utilization in a multi-step processes, wherein multiple polishing pads and slurries of varying characteristics are used in succession, to one step processes, where one polishing pad and one or more slurries arc used throughout the entire polishing phase. Alternatively, or in addition, a pad configured with polyurethane polishing elements may be suitable for planarizing steps while a pad with polishing elements made from PVA may be suitable for buffing and cleaning steps.

In some embodiments of the present invention, the polishing pad may be configured with the capability to quantitatively determine wear of the pad's polishing surface or simply "end of pad life". For example, an "end of pad life" sensor, or more generally a "detection sensor" may be embedded in the pad at a predetermined depth from the top surface (i.e., as measured from the tip of the polishing elements). As the pad wears up to the preset thickness at which the sensor is placed or activated, the sensor detects the wear and provides input to the polishing system.

The end of life sensor may consist of an optically transparent cylindrical plug having a top surface covered with reflective coating. The plug may be embedded in the pad such that the reflective end of the plug is positioned below the top surface of the pad by a predetermined height. A light source and detector arc placed in the platen of the polishing apparatus through an optically transparent window. When the light bean is incident on the plug of a new pad, the reflective surface reflects back the light indicating the pad is still within its useful life. However, when the pad has worn to a predetermined level and the top of the plug is approximately level with the now exposed pad surface, the reflective surface will be abraded away and the light will be transmitted through the pad. The resulting change in the reflected light signal intensity thus provides feedback illustrative of the pad wear. This change can be used to determine "end of pad life" (e.g., end of life may be indicated by the reflected signal intensity being at or below a previously established threshold).

The detection hardware may lie below the pad (and platen) or above the pad and that the optical insert can be appropriately modified to detect and interpret the reflected light signal. One or multiple such plugs may be used to determine percentage of remaining pad life. For example, different plugs may be embedded to different depths, corresponding to 25%, 50%, 75% and 100% (or other increments) of pad life. In this way pad wear information can be provided.

In another embodiment of the present invention a single conical plug may mounted flush with the pad surface such that the size of the plug opening exposed during pad usage provides information on the percentage of pad wear and, hence, pad life. In yet another embodiment the plug may have a multi-step surface, which is exposed to varying degrees as the pad wears. The height of the steps may be calibrated to provide information in terms of percentage of pad wear.

In still a further embodiment of the present invention, the pad life sensor plug may contain screens with varying degrees of transmission arranged in order of reflectivity. For example, the top layer may have 100% reflectivity (e.g., full reflectivity for that plug) and be flush (or nearly so) with the new pad surface. At 25% of plug depth, a screen with, say, 75% reflectivity may be embedded, and similarly at 50% of plug depth, a 50% reflectivity screen so embedded and at 75% of plug depth a 25% reflectivity screen so embedded. Of course these relative depths and reflectivity percentages may be varied to achieve similar functionality according to the designer's particular needs.

Initially with such a plug/screen arrangement, the incident beam will be completely reflected and pad life determined to be 100% (i.e., a new pad). As the pad wears, the top reflecting layer is removed and the 75% (and lower) reflectivity screens are engaged. As each such screen is exposed (and subsequently removed by further wear), the remaining pad life can be determined according to the intensity of the reflected signal. A single element can therefore be used to detect and monitor pad life.

In varying embodiments of the present invention, the sensor may be an electrochemical sensor containing two or more probes embedded in the pad at a predetermined depth or depths from the top surface of the pad when new. As the pad wears, exposing the probes, slurry provides electrical connectivity between the probes, and resulting electrical signal paths formed thereby can be used to transmit or transport signals to a detector so as to detect pad wear and, eventually, end of pad life.

In still other embodiments, the sensor may be a conductive plate embedded at a predetermined depth below the surface of a pad when new. An external capacitive or eddy current sensor may be used to detect distance from the conductive plate, hence pad thickness or pad wear. This and other embodiments of the present invention are discussed further below.

As apparent from the above description, the polishing elements may be constructed such that they have a base diameter larger than the diameter of the holes (in the compressible under layer and/or the slurry distribution layer) through which they pass. For example, the tips of the polishing elements may have a diameter "a" and the compressible under layer/slurry distribution layer holes a diameter "b", such that "b" is slightly larger than "a", but nevertheless smaller than diameter "c", which is the diameter of the base of the polishing clement. In essence then polishing elements will resemble a cylinder on top of a flat plate. In varying embodiments, the depth and spacing of the holes throughout the compressible under layer/slurry distribution layer may be varied according to an optimized scheme tailored to specific CMP processes.

As indicated above, the volume between the polishing elements may be at least partially filled with the slurry distribution material. The slurry distribution material may include flow resistant elements such as baffles, grooves, or pores, to regulate slurry flow rate during CMP processing. In varying embodiments, the slurry distribution material has between 10 and 90 percent porosity. The slurry distribution material may be comprised of various layers of differing materials to achieve desired slurry flow rates at varying depths (from the polishing surface) of the slurry distribution material. For example, a surface layer at the polishing surface may have larger pores to increase the amount and rate of slurry flow on the surface while a lower layer may have smaller pores to keep more slurry near the surface layer to help regulate slurry flow.

The thickness of the polishing pad will affect the rigidity and physical characteristics of the polish pad during use. In one embodiment, the thickness may be 25 millimeters (from the bottom of the pad to the top of a polishing element tip), however, this value may vary from 3 to 10 millimeters according to the materials used in constructing the polishing pad 300 and the type of CMP process to be performed.

The compressible under-layer provides, among others features, a positive pressure directed toward the polishing surface of the pad when compressed. Typically, the compression may vary around 10% at 5 psi (pounds per square inch), however, the compression may be varied depending upon the materials used and the type of CMP process. For example, the compressible under-layer may be formed of BONDTEX™ foam made by RBX Industries, Inc. or Poron™ Performance Urethane made by Rogers Corp.

In various embodiments, the polishing elements may protrude above the slurry distribution material or compressible under layer (if no separate slurry distribution layer is used) by, say, 2.5 millimeters or less. It will be appreciated, however, that this value may be greater than 2.5 millimeters depending on the material characteristics of the polishing elements and the desired flow of slurry over the surface.

The polishing elements are preferably interdigitated throughout the polishing pad and the distribution of the polishing elements may vary according to specific polishing/process requirements or characteristics. In varying embodiments, the polishing elements may have a density of between 30 and 80 percent of the total polishing pad surface area, as determined by the diameter of each polishing elements and the diameter of the polishing pad. As discussed above, polishing element density is directly related to the material removal rate performance: the higher the pad clement density, the higher the removal rate. While a uniform polishing element density pad allows a uniform removal profile, one way to modify the removal profile is to tailor the polishing element density such that a desired removal profile can be achieved. For example, to achieve an edge-fast polish rate, the density of polishing elements may increased in the area where the edge of the wafer comes in contact with the pad. Similarly, removal rates may be increased in the center of the wafer by adjusting polishing element density appropriately.

Polishing elements may have a generally cylindrical shape, with a generally cylindrical body mounted on a larger base element. Alternatively, or in addition, polishing elements may have a generally cylindrical body with an irregularly shaped polishing tip.

As indicated above, some polishing pads configured in accordance with embodiments of the present invention incorporate sensors to determine fractional or complete end of pad life (e.g.; pad wear leading to end of life). Optical-, electrochemical- or current-based sensors can be used to determine such wear/end of life. The sensors are incorporated into the pad, at one or more predetermined depths below the top surface thereof. The sensors, when exposed by pad wear, enable transmission of optical signals or, in case of electrochemical sensors, electrical conductivity to close circuits, thus enabling the transmission of such signals from the sensors to one or more detectors. In case of eddy current or capacitive sensors, a conductive plate may be embedded below the top surface of the pad and the detector is placed above or below the pad. The thickness of pad between the plate and the sensor thus affects the signal strength as perceived by the detector and is used to determine fractional or complete end of pad life.

Thus, improved polishing pads and processes for their use have been described. Although discussed with reference to certain illustrated examples, it should be remembered that the scope of the present invention should not be limited by such examples. For example, the polishing elements may protrude more than 1 mm above the surrounding support and slurry distribution layer. Alternatively, or in addition, the edge of the polishing pad may include a ring to retain slurry on the pad during polishing. The height of such an edge ring should be less than the height of the polishing elements. Thus, the true scope of the invention should be measured only in terms of the claims, which follow.

What is claimed is:

1. A polishing pad, comprising a plurality of polishing elements, each of the polishing elements secured so as to restrict lateral movement thereof with respect to others of the polishing elements, but remaining moveable in an axis normal to a polishing surface of the polishing elements, and a compressible under layer, each of the polishing elements being secured to the compressible under layer and protruding above a top surface of the compressible under layer, wherein the polishing elements are secured to the compressible under layer using one or more of the following clamps: "L"-shaped clamps, "T"-shaped clamps, or torus-shaped clamps.

2. A polishing pad, comprising a plurality of polishing elements, each of the polishing elements secured so as to restrict lateral movement thereof with respect to others of the polishing elements, but remaining moveable in an axis normal to a polishing surface of the polishing elements, wherein each individual one of the polishing elements is affixed to an individual compressible under layer.

3. A polishing pad, comprising a plurality of polishing elements, each of the polishing elements secured so as to restrict lateral movement thereof with respect to others of the polishing elements, but remaining moveable in an axis normal to a polishing surface of the polishing elements, wherein at least some of the polishing elements interlock with others of the polishing elements.

4. A polishing pad, comprising a plurality of polishing elements, each of the polishing elements secured so as to restrict lateral movement thereof with respect to others of the polishing elements, but remaining moveable in an axis normal to a polishing surface of the polishing elements, wherein the polishing elements are secured using guide pins embedded within a compressible under layer of the polishing pad.

5. The polishing pad of claim 1, wherein the polishing elements have a Shore D hardness greater than 80.

6. The polishing pad of claim 1, wherein the polishing elements are arranged in groups, each of the polishing elements of a group configured to act in concert, but independent of polishing elements of other groups.

7. The polishing pad of claim 2, further comprising a guide plate through which the polishing elements protrude.

8. The polishing pad of claim 1, wherein the polishing elements protrude more than 1 mm above the surrounding support and slurry distribution layer.

9. The polishing pad of claim 1, wherein an edge of the polishing pad includes a ring configured to retain slurry on the pad during polishing.

10. The polishing pad of claim 9, wherein the height of the ring of the polishing pad is less than a height of the polishing elements.

* * * * *